US005762776A

United States Patent [19]

Alexander et al.

[11] Patent Number: 5,762,776

[45] Date of Patent: Jun. 9, 1998

[54] SPACER FOR ELECTRODES

[75] Inventors: Graeme Alexander, Tucson, Ariz.; Carlos Trautmann, I, Santiago, Chile

[73] Assignee: Quadna, Inc., Tucson, Ariz.

[21] Appl. No.: 801,583

[22] Filed: Feb. 18, 1997

[51] Int. Cl.[6] ..... C25D 5/00; C25D 17/00

[52] U.S. Cl. ..... 205/80; 204/267; 204/279

[58] Field of Search ..... 204/279, 269, 204/267, 281; 205/80

[56] References Cited

U.S. PATENT DOCUMENTS 3,997,421 12/1976 Perri et al. ..... 204/267

4,619,751 10/1986 Robinson ..... 240/279

*Primary Examiner*—Donald R. Valentine

*Attorney, Agent, or Firm*—Antonio R. Durando

[57] ABSTRACT

A spacer for electrodes has pair of walls which define a channel for an edge of an electrode. An arm extends from an edge of each wall, and the arms include respective sections which flare to opposite sides of the channel. Each arm can include an additional section which extends from the associated flaring section and is inclined towards the opposite wall.

22 Claims, 2 Drawing Sheets

SPACER FOR ELECTRODES

BACKGROUND OF THE INVENTION

1.Field of the Invention

The invention relates to a spacer for electrodes.

2.Description of the Prior Art

An electrolytic cell for the electrodeposition of a metal such as copper contains a series of anodes and cathodes which are immersed in an electrolytic bath. The cathodes, which are longer than and extend beyond the anodes, alternate with the latter in substantially parallel arrangement.

The cathodes and anodes must be prevented from contacting one another and, to this end, insulating spacers are mounted on the anodes. The spacers commonly used for copper electrodeposition are the button and hairpin spacers which are positioned towards the centers of the anodes and cathodes. These spacers change the current density thereby causing non-uniform deposition of copper. This effect is frequently worsened by the entrapment of impurities in the deposited copper.

SUMMARY OF THE INVENTION

It is an object of the invention to provide a spacer which enables electrodeposition to proceed more uniformly.

The preceding object, as well as others which will become apparent as the description proceeds, are achieved by the invention.

One aspect of the invention resides in a device for spacing electrodes. The device comprises a holding element mountable at an edge of an electrode, and at least one arm fast with the holding element. The arm includes at least one arm section which flares to one side of the holding element.

In an electrode array of the type where the cathodes project beyond the anodes, no significant deposition takes place on the projecting portions of the cathodes. The spacing device of the invention is designed to take advantage of this phenomenon. Thus, the holding element allows the spacing device to be mounted at the edge of an anode. The flaring arm section, on the other hand, enables the spacing device to contact the projecting portion of a neighboring cathode. The spacing function is accordingly shifted from the critical central region of a cathode to the non-critical end thereof.

Additional features and advantages of the invention will be forthcoming from the following detailed description of preferred embodiments when read in conjunction with the accompanying drawings.

DESCRIPTION OF THE PREFERRED EMBODIMENTS

Figure 1:
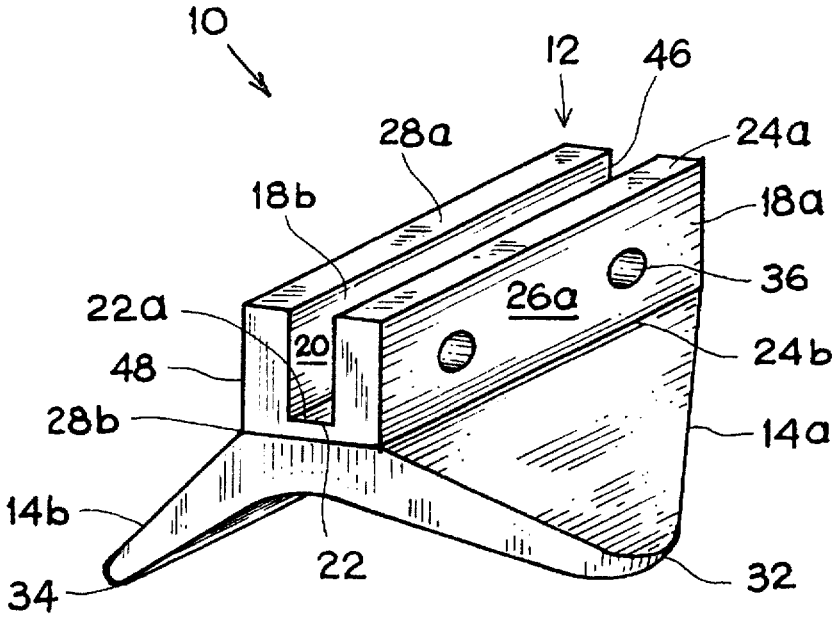
FIG. 1 is a perspective view of one embodiment of a spacing device according to the invention.

Referring to FIG. 1, the numeral 10 identifies a device according to the invention for spacing electrodes. The spacing device 10, which is made of an insulating material, comprises a holding element or portion 12 and a pair of arms or wings **14*a* and 14*b* which flare to opposite sides of the holding element 12**.

Figure 2:
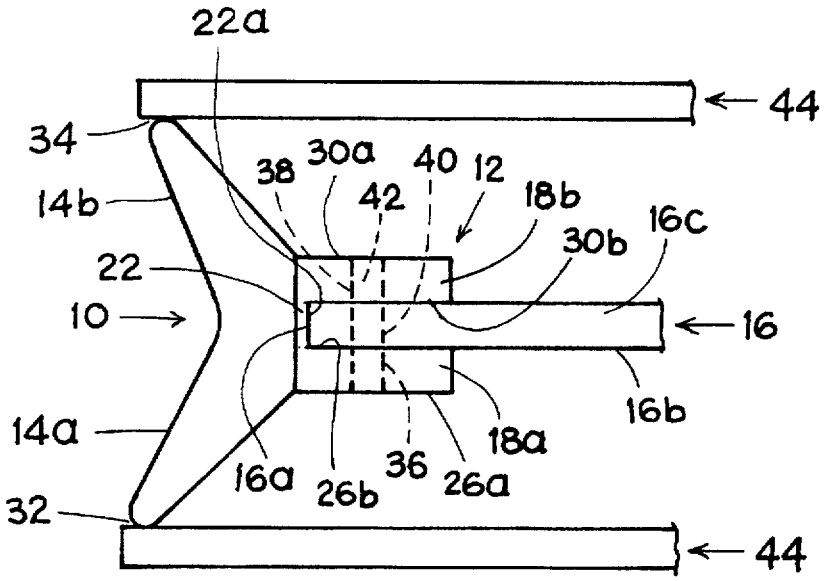
FIG. 2 is a fragmentary top view of part of an electrode array which includes the spacing device of FIG. 1.

As shown in FIG. 2, the holding element 12 is designed to be mounted at a lateral edge **16*a* of an electrode 16. To this end, the holding element 12 includes a pair of spaced, flat and parallel side walls 18*a* and 18*b*. The side walls 18*a*,18*b* oppose one another and define a channel 20 of square or rectangular cross section. The channel 20 has a width slightly larger than the thickness of the electrode 16 so that the lateral edge 16*a* of the electrode 16 can be inserted in the channel 20. The side walls 18*a*,18*b* are bridged by an end wall 22 which delimits the bottom of the channel 20**.

The electrode 16, which is here assumed to be an anode, has opposite major surfaces **16*b* and 16*c***.

The walls **18*a*,18*b*,22 are elongated. The side wall 18*a* has opposite longitudinal edges 24*a* and 24*b* as well as opposite major surfaces 26*a* and 26*b*. The major surface 26*a* faces away from the channel 20 whereas the major surface 26*b* faces towards the channel 20 and is arranged to confront the major surface 16*b* of the anode 16**.

The side wall **18*b* has opposite longitudinal edges 28*a* and 28*b* as well as opposite major surfaces 30*a* and 30*b*. The major surface 30*a* faces away from the channel 20 while the major surface 30*b* faces towards the channel 20 and is arranged to confront the major surface 16*c* of the anode 16**.

The end wall 22 has a major surface **22*a* which faces towards the channel 20 and is arranged to confront the lateral edge 16*a* of the anode 16**.

The arm **14*a* projects from the longitudinal edge 24*b* of the side wall 18*a* to that side of the wall 18*a* remote from the side wall 18*b*. At the longitudinal edge 24*b*, the arm 14*a* runs the length of the side wall 18*a*. The arm 14*a* narrows or tapers laterally in a direction away, to a blunt apex 32 remote, from the side wall 18*a*. The arm 14*a* thus has an approximately triangular configuration. The arm 14*a* is generally flat and defines an obtuse angle with the side wall 18*a***.

The arm **14*b* projects from the longitudinal edge 28*b* of the side wall 18*b* to that side of the wall 18*b* remote from the side wall 18*a*. At the longitudinal edge 28*b*, the arm 14*b* runs the length of the side wall 18*b*. The arm 14*b* narrows or tapers laterally in a direction away, to a blunt apex 34 remote, from the side wall 18*b*. The arm 14*b* is accordingly approximately triangular. The arm 14*b* is generally flat and defines an obtuse angle with the side wall 18*b***.

The side wall **18*a* is provided with a pair of openings 36 and the side wall 18*b* with a pair of openings 38. Only one of the openings 38 in the side wall 18*b* can be seen in the drawings. The openings 36 are in register with respective ones of the openings 38**.

The anode 16 is formed with two openings 40 of which only one is visible in the drawings. Each of the openings 40 can be aligned with a respective opening 36 in the side wall **18*a* and the corresponding opening 38 in the side wall 18*b*. A pin 42 can be inserted in each set of registering openings 36,38,40 to secure the spacing device 10 to the anode 16. The pin 42 may be a friction fit in the openings 36,38,40**.

As seen in FIG. 2, a cathode 44 is disposed on either side of the anode 16 at a spacing therefrom. The cathodes 44 are longer than, and project beyond the edge 16a of, the anode 16. The anode 16 and cathodes 44 constitute part of an electrode array made up of alternating anodes and cathodes which are situated side-by-side and are generally parallel to one another. Electrode arrays of this type are used for the electrodeposition of copper, and copper is deposited on those parts of the cathodes which overlap the anodes but not on those parts of the cathodes which project beyond the anodes.

In operation, the spacing device 10 is mounted at the lateral edge 16*a* of the anode 16 before the anode 16 is positioned in the electrode array. After the spacing device 10 has been secured to the anode 16, the latter is lowered into the gap between the cathodes 44. The spacing device 10 has opposite longitudinal ends 46 and 48, and one of the longitudinal ends 46,48 constitutes the leading end of the spacing device 10 in the direction of descent. The design of the spacing device 10 is such that neither longitudinal end 46,48 has sharp edges which can catch on other objects. Hence, lowering of the anode 16 proceeds smoothly.

The arms 14*a*,14*b* serve to hold the cathodes 44 at a distance from the anode 16. Due to the mounting of the spacing device 10 at the lateral edge 16*a* of the anode 16, and due also to the flare of the arms 14*a*,14*b*, the arms 14*a*,14*b* are able to engage the parts of the cathodes 44 which project beyond the lateral edge 16*a* of the anode 16. Accordingly, the spacing device 10 has little, if any, effect on deposition.

Figure 3:
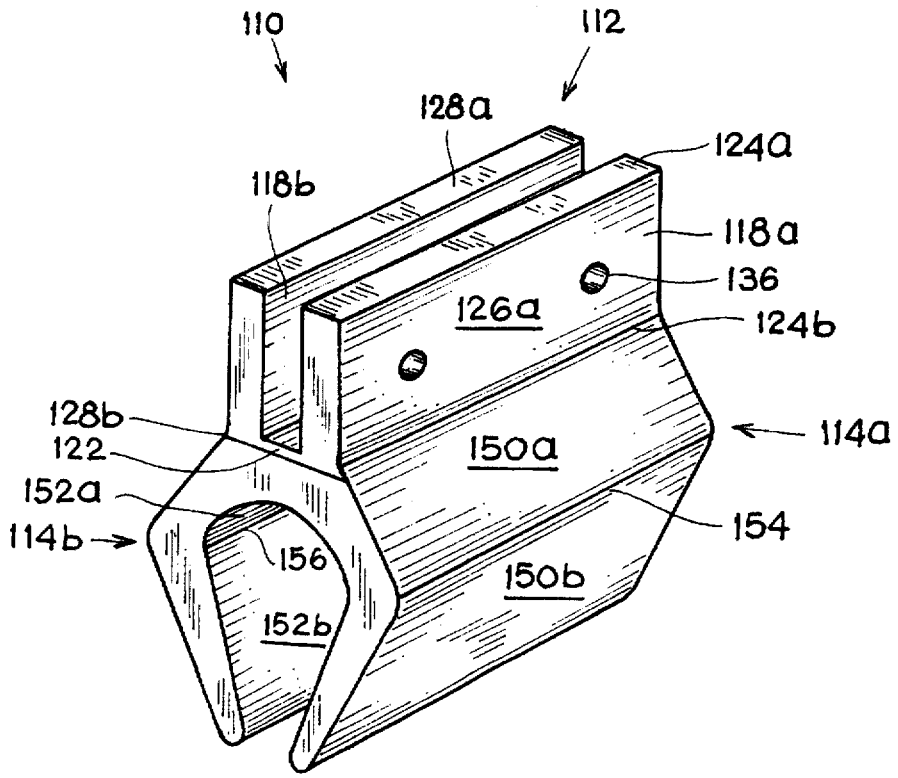
FIG. 3 is a perspective view of another embodiment of a spacing device in accordance with the invention.
Figure 4:
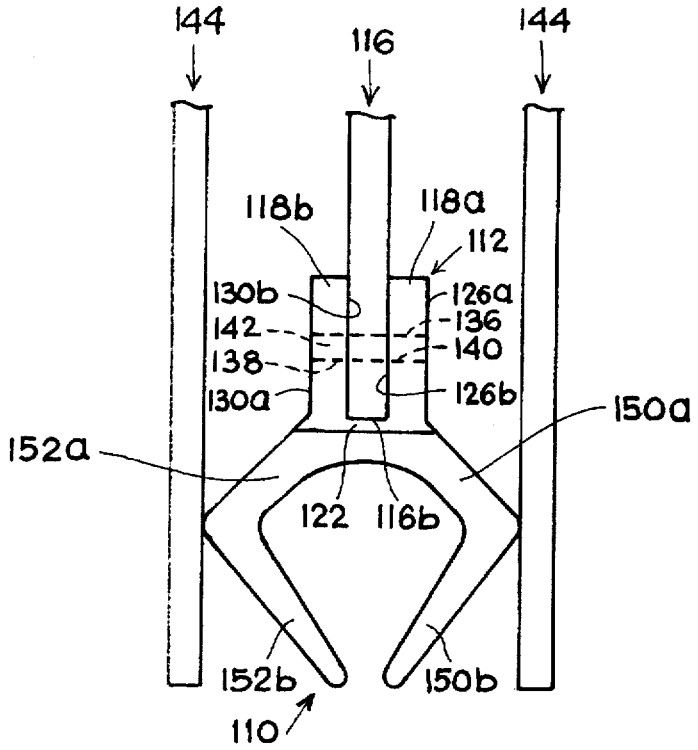
FIG. 4 is a fragmentary end view of part of an electrode array which includes the spacing device of FIG. 3.

FIGS. 3 and 4 illustrate another embodiment of a spacing device in accordance with the invention. In FIGS. 3 and 4, the same numerals as in FIGS. 1 and 2, plus 100, are used to identify corresponding elements.

The spacing device 110 differs from the spacing device 10 primarily in two ways. First, the arms 114*a* and 114*b* of the spacing device 110 are not tapered. Second, the arm 114*a* includes two sections 150*a* and 150*b* while the arm 114*b* includes two sections 152*a* and 152*b*.

The arm sections 150*a*,150*b*,152*a*,152*b* are generally flat, and the arm sections 150*a*,152*a* flare from the holding element 112 to opposite sides thereof like the arms 14*a*,14*b*.

The arm section 150*a* of the arm 114*a* has a longitudinal edge 154 which is remote from, and parallel to the longitudinal edge 124*b* of, the holding element 112. The arm section 150*b* of the arm 114*a* extends from the longitudinal edge 154 and is inclined with respect to the arm section 150*a* towards the arm 114*b*. The arm sections 150*a* and 150*b* define an obtuse angle.

The arm section 152*a* of the arm 114*b* has a longitudinal edge 156 which is remote from, and parallel to the longitudinal edge 128*b* of, the holding element 112. The arm section 152*b* of the arm 114*b* extends from the longitudinal edge 156 and is inclined with respect to the arm section 152*a* towards the arm 114*a*. The arm sections 152*a* and 152*b* define an obtuse angle.

The spacing device 110 is designed to be mounted at the bottom edge 116*b* of the anode 116 as shown in FIG. 4. When the anode 116 with the spacing device 110 is lowered into the gap between the cathodes 114, the leading end of the spacing device 110 is constituted by the arm sections 150*b*, 152*b*. The inclination of the arm sections 150*b*,152*b* towards one another results in a tapered profile which inhibits catching of the spacing device 110 on other objects.

Various modifications are possible within the meaning and range of equivalence of the appended claims.

We claim:

1. A device for spacing electrodes comprising:

a holding element mountable at an edge of an electrode; and at least one arm fast with said holding element, said one arm including at least one arm section which flares to one side of said holding element and away from an additional side opposite said one side, said holding element and said one arm section having respective surface portions which merge into or intersect one another and face away from said additional side, and said surface portions defining an obtuse angle with each other.

2. The device of claim 1, further comprising an additional arm fast with said holding element, said additional arm including an additional arm section which flares to said additional side and away from said one side, said holding element and said additional arm section having respective additional surface portions which merge into or intersect one another and face away from said one side, and said additional surface portions defining an obtuse angle with each other.

3. The device of claim 1, wherein said one arm section has a pair of lateral edge faces which converge in a direction away from said holding element so that said one arm section narrows in said direction.

4. The device of claim 1, wherein said holding element comprises a wall having an edge, said one arm section intersecting said wall in the region of said edge.

5. The device of claim 1, wherein said holding element comprises a pair of spaced walls which cooperate to define a channel for the electrode.

6. The device of claim 5, wherein each of said walls has an edge and said one arm section intersects one of said walls in the region of the respective edge; and further comprising an additional arm fast with said holding element, said additional arm including an additional arm section which flares to said additional side and away from said one side, and said holding element and said additional arm section having respective additional surface portions which merge into or intersect one another and face away from said one side, said additional surface portions defining an obtuse angle with each other, and said additional arm section intersecting the other of said walls in the region of the respective edge.

7. The device of claim 1, wherein said holding element is provided with means for attaching said holding element to the electrode.

8. The device of claim 1, wherein said one arm comprises another arm section extending from said one arm section at an inclination thereto.

9. The device of claim 8, further comprising an additional arm fast with said holding element, said additional arm including a first additional arm section which flares to said additional side and away from said one side, and said holding element and said first additional arm section having respective additional surface portions which merge into or intersect one another and face away from said one side, said additional surface portions defining an obtuse angle with each other, and said additional arm also including a second additional arm section extending from said first additional arm section at an inclination thereto, said second additional arm section being inclined towards said one arm and said other arm section being inclined towards said additional arm.

10. The device of claim 9, wherein said holding element comprises a pair of spaced walls which cooperate to define a channel for the electrode, each of said walls having an edge, and said one arm section intersecting one of said walls in the region of the respective edge, said first additional arm section intersecting the other of said walls in the region of the respective edge.

11. A method for spacing electrodes comprising the following steps:

mounting a holding element at an edge of an electrode, said holding element being fast with at least one arm, and said one arm including at least one arm section which flares to one side of said holding element and away from an additional side opposite said one side, said holding element and said one arm section having respective surface portions which merge into or intersect one another and face away from said additional side, and said surface portions defining an obtuse angle with each other; and inserting said electrode adjacent another electrode in an electrolytic bath.

12. The method of claim 11, further comprising an additional arm fast with said holding element, said additional arm including an additional arm section which flares to said additional side and away from said one side, said holding element and said additional arm section having respective additional surface portions which merge into or intersect one another and face away from said one side, and said additional surface portions defining an obtuse angle with each other.

13. The method of claim 11, wherein said one arm section has a pair of lateral edge faces which converge in a direction away from said holding element so that said one arm section narrows in said direction.

14. The method of claim 11, wherein said holding element is provided with a wall having an edge, said one arm section intersecting said wall in the region of said edge.

15. The method of claim 11, wherein said holding element is provided with a pair of spaced walls which cooperate to define a channel for the electrode.

16. The method of claim 15, wherein each of said walls has an edge and said one arm section intersects one of said walls in the region of the respective edge; and further comprising an additional arm fast with said holding element, said additional arm including an additional arm section which flares to said additional side and away from said one side, and said holding element and said additional arm section having respective additional surface portions which merge into or intersect one another and face away from said one side, said additional surface portions defining an obtuse angle with each other, and said additional arm section intersecting the other of said walls in the region of the respective edge.

17. The method of claim 11, wherein said holding element is provided with means for attaching said holding element to the electrode.

18. The method of claim 11, wherein said one arm is provided with another arm section extending from said one arm section at an inclination thereto.

19. The method of claim 18, further comprising an additional arm fast with said holding element, said additional arm including a first additional arm section which flares to said additional side and away from said one side, and said holding element and said first additional arm section having respective additional surface portions which merge into or intersect one another and face away from said one side, said additional surface portions defining an obtuse angle with each other, and said additional arm also including a second additional arm section extending from said first additional arm section at an inclination thereto, said second additional arm section being inclined towards said one arm and said other arm section being inclined towards said additional arm.

20. The method of claim 19, wherein said holding element is provided with a pair of spaced walls which cooperate to define a channel for the electrode, each of said walls having an edge, and said one arm section intersecting one of said walls in the region of the respective edge, said first additional arm section intersecting the other of said walls in the region of the respective edge.

21. A device for spacing electrodes comprising:

a holding element mountable at an edge of an electrode; and at least one arm fast with said holding element, said one arm including at least one arm section which flares to one side of said holding element and away from an additional side opposite said one side, and said one arm section having a pair of lateral edge faces which converge in a direction away from said holding element so that said one arm section narrows in said direction.

22. A method for spacing electrode compromising the following steps:

mounting a holding element at an edge of an electrode, said holding element being fast with at least one arm, and said one arm including at least one arm section which flares to one side of said holding element and away from an additional side opposite said one side, said one arm section having a pair of lateral edge faces which converge in a direction away from said holding element so that said one arm section narrows in said direction; and inserting said electrode adjacent another electrode in an electrolytic bath.

* * * * *